US010436438B1

(12) United States Patent
Eagan

(10) Patent No.: US 10,436,438 B1
(45) Date of Patent: Oct. 8, 2019

(54) CUSTOMIZABLE HOLIDAY DECORATION

(71) Applicant: Roger Eagan, Wallowa, OR (US)

(72) Inventor: Roger Eagan, Wallowa, OR (US)

( * ) Notice: Subject to any disclaimer, the term of this patent is extended or adjusted under 35 U.S.C. 154(b) by 142 days.

(21) Appl. No.: 15/805,249

(22) Filed: Nov. 7, 2017

(51) Int. Cl.

| | |
|---|---|
| ***B42D 15/02*** | (2006.01) |
| ***G09F 1/00*** | (2006.01) |
| ***F21V 33/00*** | (2006.01) |
| ***B44F 1/06*** | (2006.01) |
| ***B44C 5/04*** | (2006.01) |
| ***F21S 8/00*** | (2006.01) |
| ***F21V 23/04*** | (2006.01) |
| *F21V 23/02* | (2006.01) |
| *B44F 1/08* | (2006.01) |
| *B44C 5/02* | (2006.01) |
| *F21S 9/02* | (2006.01) |

(52) U.S. Cl.
CPC ..... *F21V 33/0032* (2013.01); *B44C 5/0446* (2013.01); *B44F 1/06* (2013.01); *F21S 8/036* (2013.01); *F21V 23/0414* (2013.01); *B44C 5/02* (2013.01); *B44F 1/08* (2013.01); *F21S 9/02* (2013.01); *F21V 23/023* (2013.01)

(58) Field of Classification Search
CPC ..... F21V 23/0414; F21V 23/023; F21V 33/0032; B44F 1/08; B44F 1/06; B44C 5/0446; B44C 5/02; F21S 8/036; F21S 9/02; G09F 1/00; G09F 1/02; G09F 1/04; G09F 1/08; G09F 1/06; G09F 1/065; G09F 25/00; G09F 23/04; G09F 27/00
See application file for complete search history.

(56) References Cited

U.S. PATENT DOCUMENTS

| | | | | |
|---|---|---|---|---|
| 2,725,654 | A | 12/1955 | Kosikar | |
| D226,614 | S | 4/1973 | Stauffer | |
| 5,315,492 | A | 5/1994 | Davenport | |
| D440,525 | S | 4/2001 | Robinson | |
| 6,478,448 | B1 | 11/2002 | Gary | |
| 6,709,765 | B2 | 3/2004 | Walling | |
| 8,230,624 | B2 * | 7/2012 | Sapp | B42D 15/022 40/124.03 |
| 8,813,397 | B2 * | 8/2014 | Budzar | G09F 1/06 40/124.03 |
| 9,156,301 | B2 * | 10/2015 | Flesher | B42D 15/045 |

(Continued)

FOREIGN PATENT DOCUMENTS

CA 2387204 A1 11/2003

*Primary Examiner* — Anh T Mai
*Assistant Examiner* — Arman B Fallahkhair

(57) ABSTRACT

The customizable holiday decoration is a display device. The customizable holiday decoration displays a sentiment. The customizable holiday decoration has a mechanical component and an electrical component. The mechanical component of the customizable holiday decoration physically moves the sentiment. The electrical component of the sentiment illuminates a plurality of lights, generates audible sounds, and powers the mechanical component of the customizable holiday decoration. The customizable holiday decoration comprises a backing plate, a decorative plate, a plurality of legs, a drive mechanism, and a control system. The decorative plate attaches to the backing plate. The mechanical component and the electrical component attach to the decorative plate. The mechanical component comprises the plurality of legs and the drive mechanism. The electrical component comprises the control system.

8 Claims, 6 Drawing Sheets

(56) References Cited

U.S. PATENT DOCUMENTS

| | | | | |
|---|---|---|---|---|
| 9,643,443 | B2 * | 5/2017 | Bogdanski | B42D 15/042 |
| 2007/0153638 | A1 | 7/2007 | Lebbing | |
| 2007/0256337 | A1 * | 11/2007 | Segan | B42D 15/045<br>40/124.03 |
| 2016/0369999 | A1 | 12/2016 | La Roque | |
| 2017/0267012 | A1 * | 9/2017 | Krieman | B42D 15/022 |

* cited by examiner

CUSTOMIZABLE HOLIDAY DECORATION

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including household and table equipment, more specifically, a decorative frame further comprising lights and moving parts.

SUMMARY OF INVENTION

The customizable holiday decoration is a display device. The customizable holiday decoration displays a sentiment. The customizable holiday decoration has a mechanical component and an electrical component. The mechanical component of the customizable holiday decoration physically moves the sentiment. The electrical component of the sentiment illuminates a plurality of lights, generates audible sounds, and powers the mechanical component of the customizable holiday decoration. The customizable holiday decoration comprises a backing plate, a decorative plate, a plurality of legs, a drive mechanism, and a control system. The decorative plate attaches to the backing plate. The mechanical component and the electrical component attach to the decorative plate. The mechanical component comprises the plurality of legs and the drive mechanism. The electrical component comprises the control system.

These together with additional objects, features and advantages of the customizable holiday decoration will be readily apparent to those of ordinary skill in the art upon reading the following detailed description of the presently preferred, but nonetheless illustrative, embodiments when taken in conjunction with the accompanying drawings.

In this respect, before explaining the current embodiments of the customizable holiday decoration in detail, it is to be understood that the customizable holiday decoration is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the customizable holiday decoration.

It is therefore important that the claims be regarded as including such equivalent construction insofar as they do not depart from the spirit and scope of the customizable holiday decoration. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
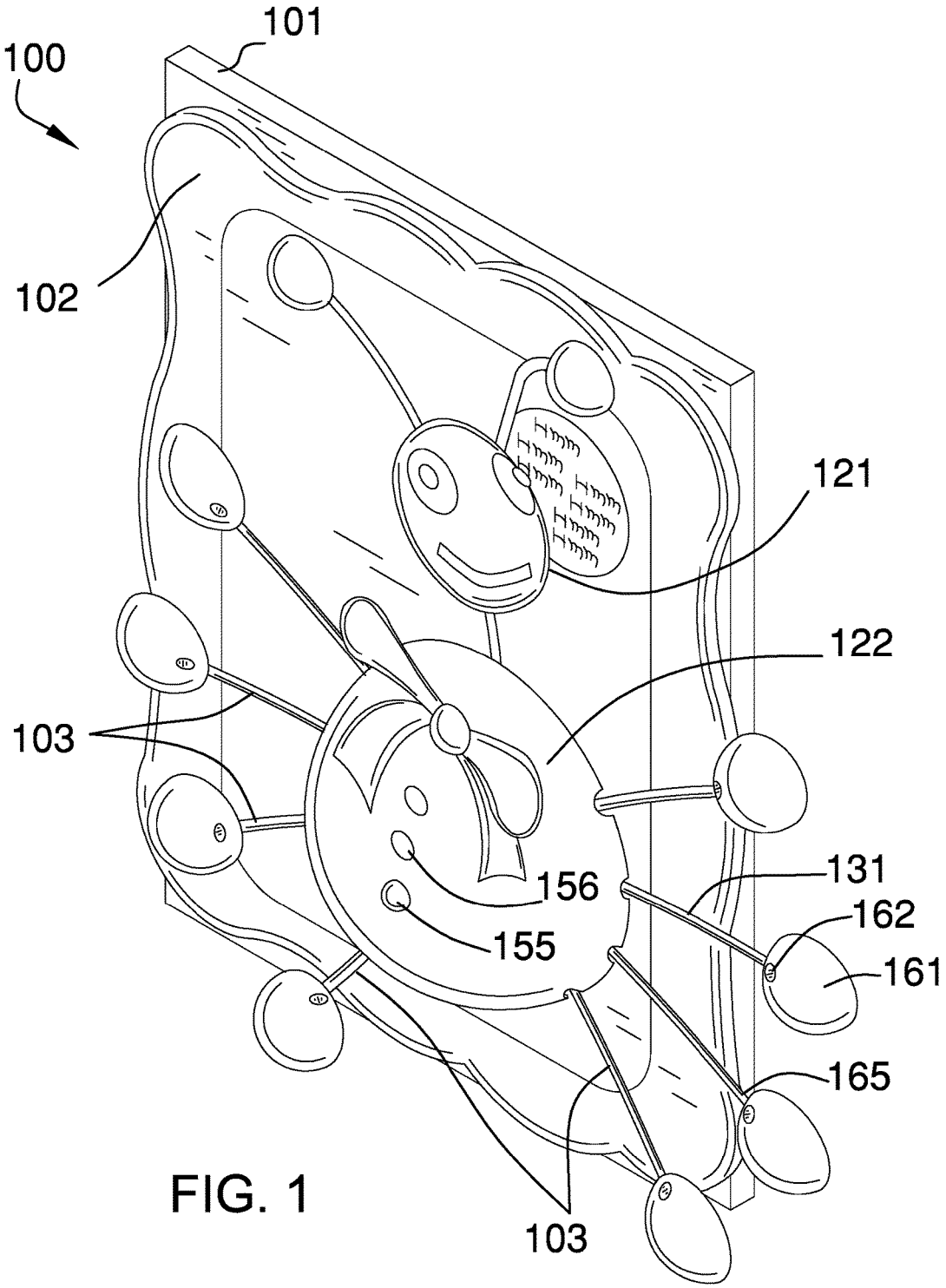
FIG. 1 is a perspective view of an embodiment of the disclosure.
Figure 2:
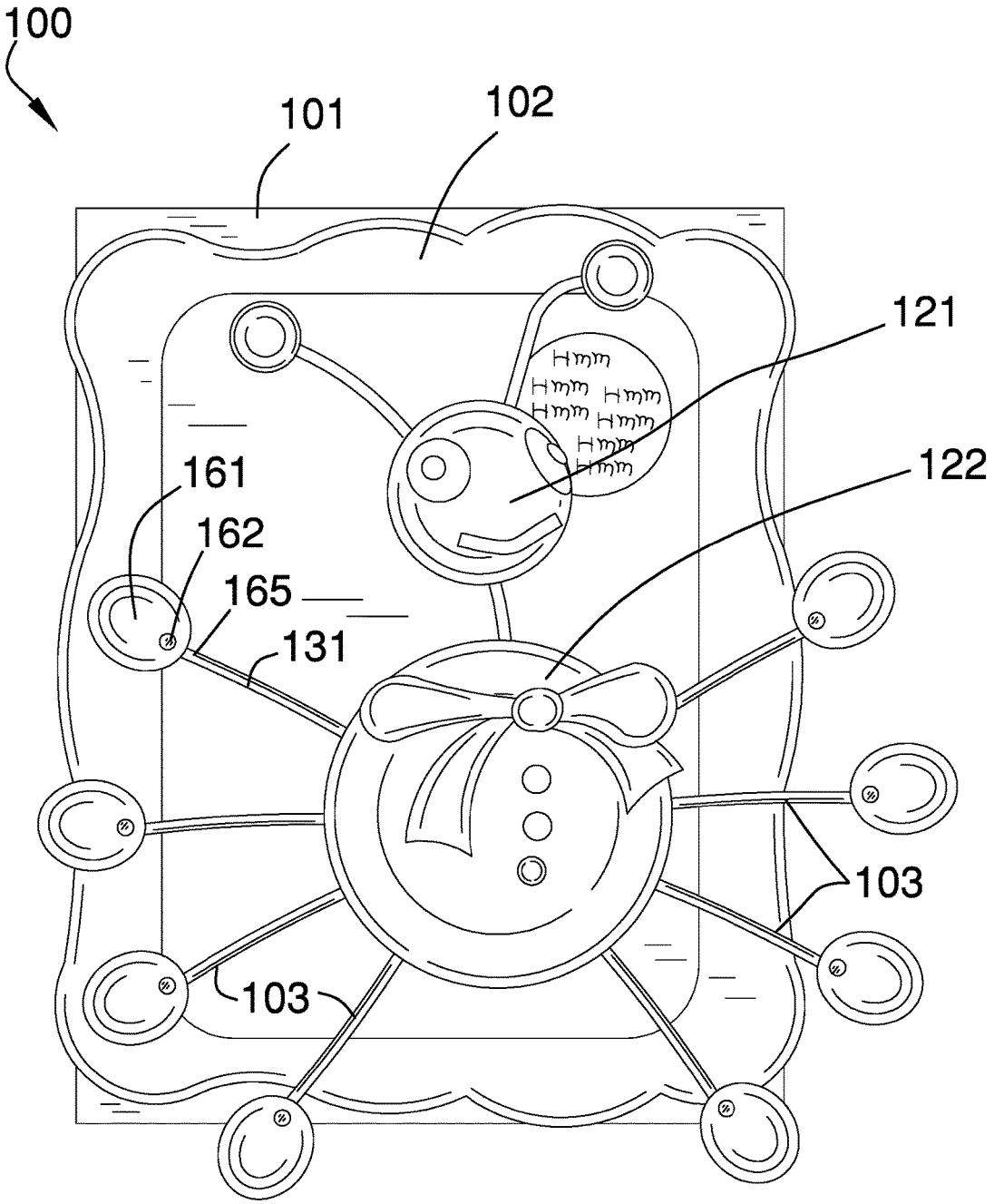
FIG. 2 is a front view of an embodiment of the disclosure.
Figure 3:
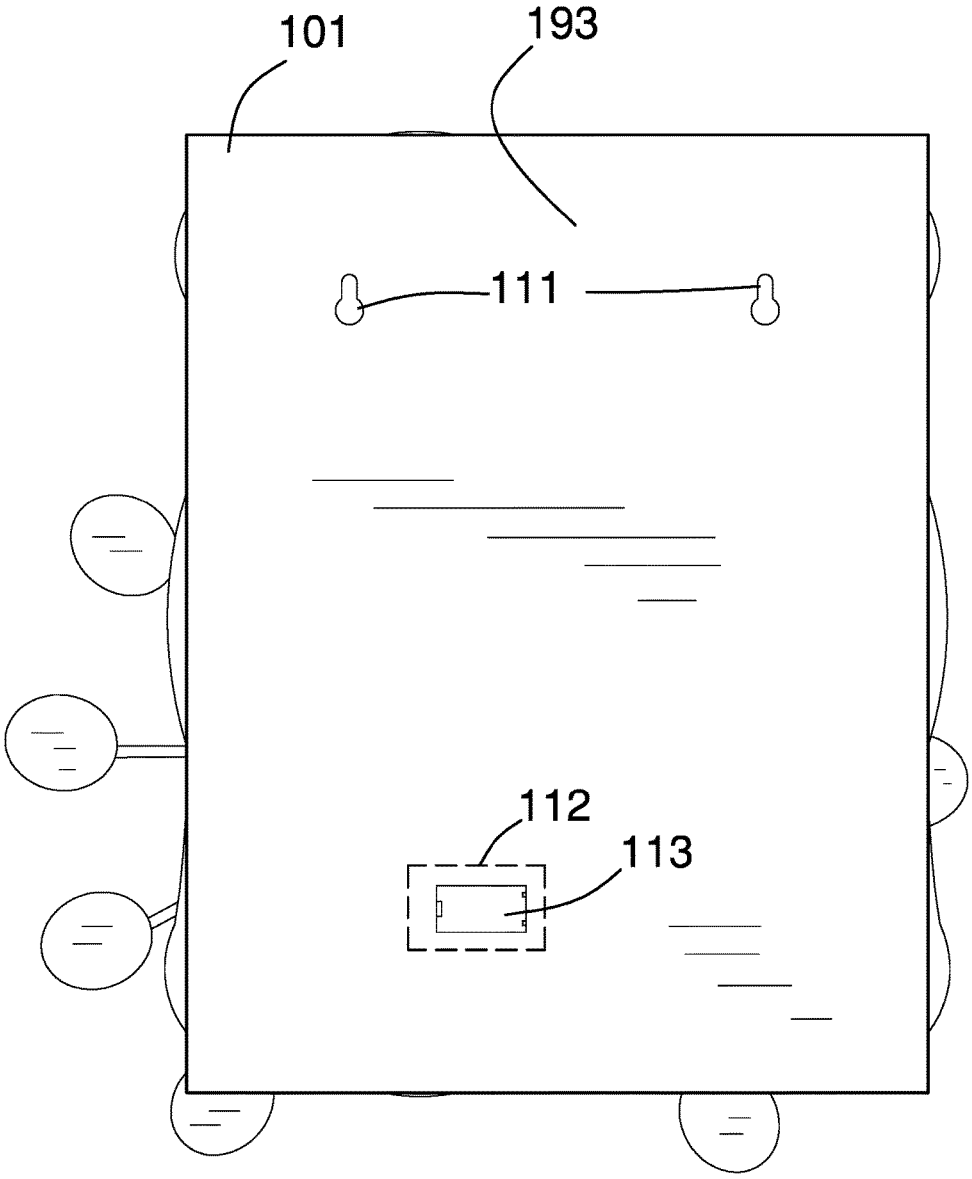
FIG. 3 is a rear view of an embodiment of the disclosure.
Figure 4:
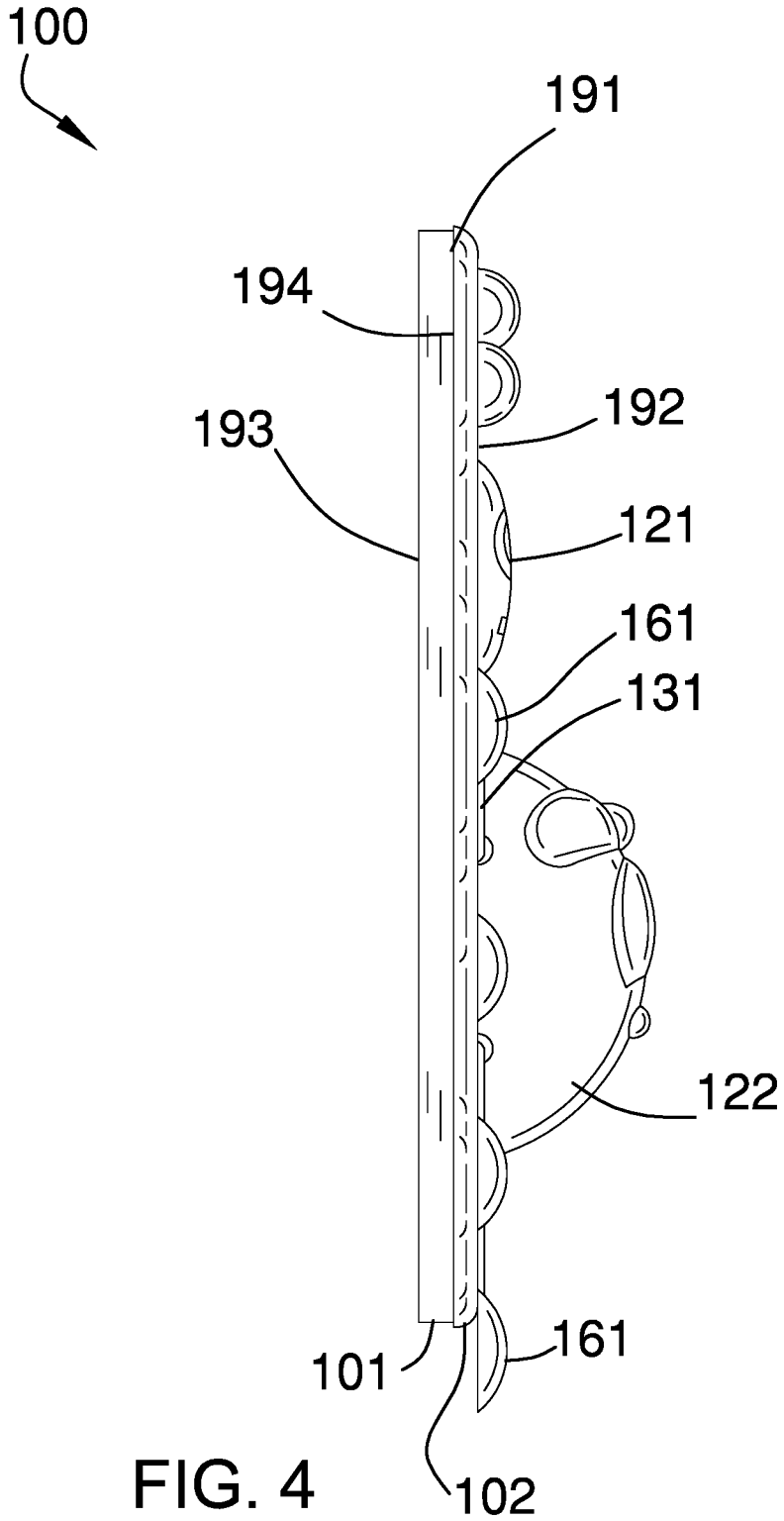
FIG. 4 is a side view of an embodiment of the disclosure.
Figure 5:
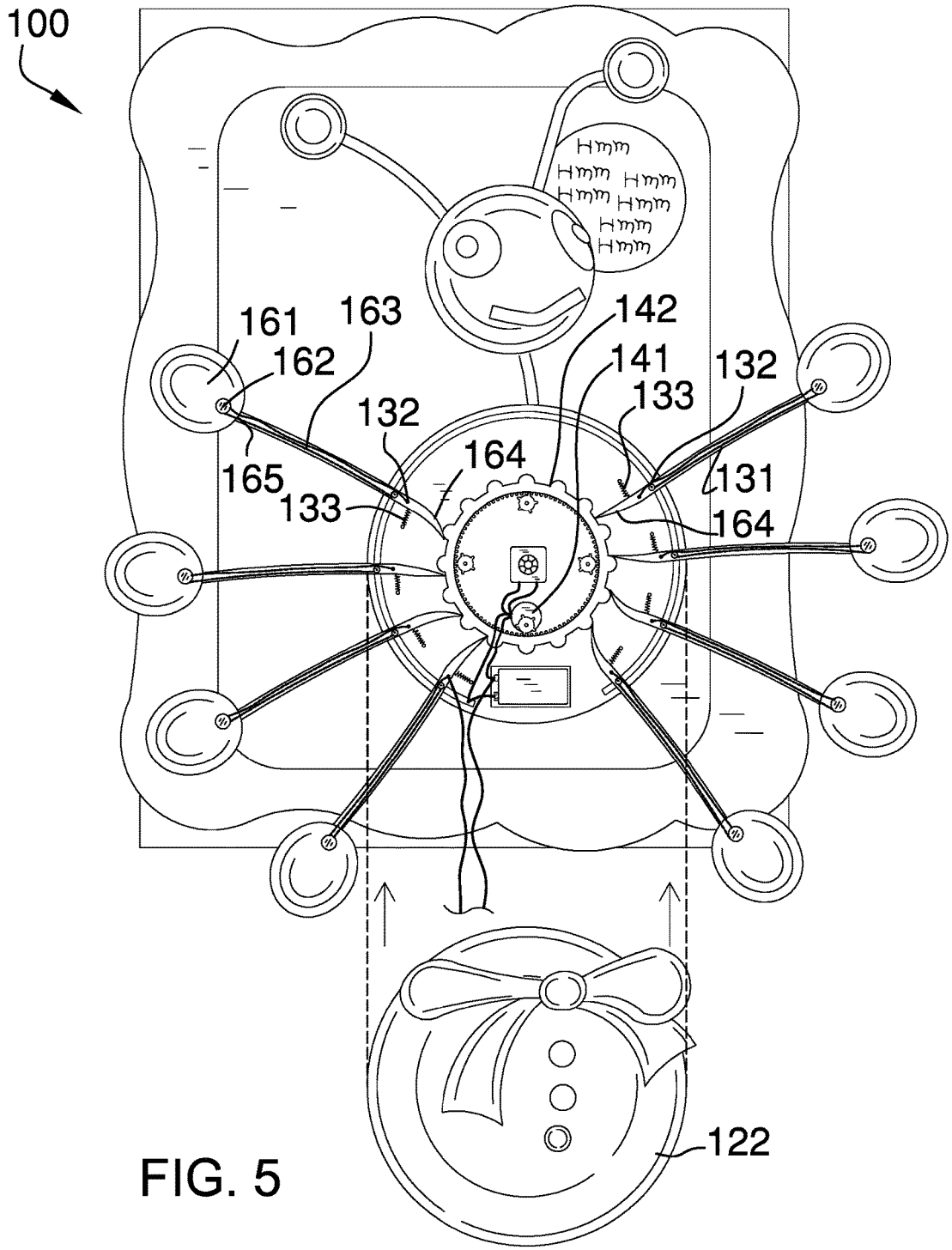
FIG. 5 is an exploded view of an embodiment of the disclosure.
Figure 6:
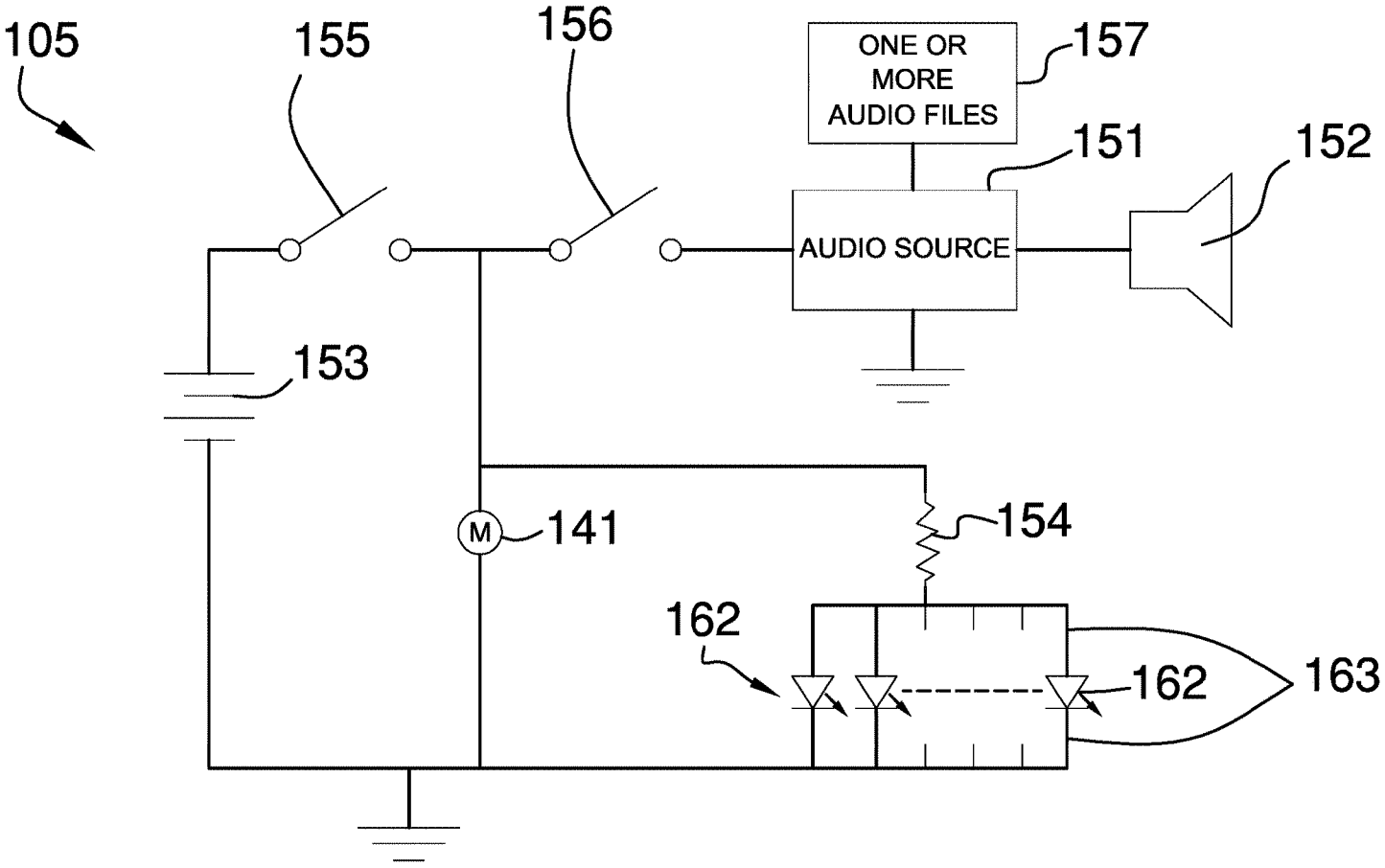
FIG. 6 is a block diagram of an embodiment of the disclosure.

Detailed reference will now be made to one or more potential embodiments of the disclosure, which are illustrated in FIGS. 1 through 6.

The customizable holiday decoration 100 (hereinafter invention) is a display device. The invention 100 displays a sentiment. The invention 100 has a mechanical component and an electrical component. The mechanical component of the invention 100 physically moves the sentiment. The electrical component of the sentiment illuminates a plurality of lights, generates audible sounds, and powers the mechanical component of the invention 100. The invention 100 comprises a backing plate 101, a decorative plate 102, a plurality of legs 103, a drive mechanism 104, and a control system 105. The decorative plate attaches to the backing plate 101. The mechanical component and the electrical component attach to the decorative plate 102. The mechanical component comprises the plurality of legs 103 and the drive mechanism 104. The electrical component comprises the control system 105.

The backing plate 101 is a rectangular plate. The backing plate 101 attaches the decorative plate 102 to a vertical surface such as a wall. The backing plate 101 further comprises a plurality of mounting holes 111, a battery chamber 112, and a battery chamber cover 113. The backing plate 101 is further defined with a first anterior surface 191 and a first posterior surface 193.

Each of the plurality of mounting holes 111 is a keyhole formed in the first posterior surface 193 of the backing plate 101. The plurality of mounting holes 111 are used to mount the invention 100 on a vertical surface. The battery chamber 112 is a cavity formed in the first posterior surface 193 of the backing plate 101. The battery chamber 112 is sized to receive the battery 153. The battery 153 is discussed in greater detail elsewhere in this disclosure. The battery chamber cover 113 is a lid that encloses the battery chamber 112.

The decorative plate 102 is a plate. The form factor of the decorative plate 102 is selected for decorative purposes. The decorative plate 102 displays an image 121. The image 121 displayed on the decorative plate 102 is an indicia of a holiday-related sentiment.

In the first potential embodiment of the disclosure, the sentiment presented by the image 121 on the decorative plate 102 is a caricature of an insect referred to informally as a "Humm-Bug." Methods to apply images to surfaces are well-known in the fine arts community.

The decorative plate 102 comprises the image 121 and a mechanism cover 122. The decorative plate 102 is further defined with a second anterior surface 192 and a second posterior surface 194. The second posterior surface 194 of the decorative plate 102 attaches to the first anterior surface 191 of the backing plate 101.

The mechanism cover 122 is a shell mounted on the decorative plate 102. The mechanism cover 122 encloses the drive mechanism 104 and the control system 105 during normal use of the invention 100. The exterior surface of the mechanism cover 122 is decorated in a manner that coordinates with and supplements the image 121 of the decorative plate 102.

The drive mechanism 104 is an electrically powered mechanical device. The drive mechanism 104 generates the force required to move each of the plurality of legs 103. The drive mechanism 104 comprises a drive motor 141 and a toothed gear 142.

The drive motor 141 is a commercially available electrical motor. The drive motor 141 attaches to the second anterior surface 192 of the decorative plate 102. The toothed gear 142 attaches to the drive motor 141 such that the drive motor 141 will rotate the toothed gear 142.

The plurality of legs 103, the drive mechanism 104, and the control system 105 attach to the second anterior surface 192 of the decorative plate 102. Any leg selected from the plurality of legs 103 is identical to the legs remaining in the plurality of legs 103. Each of the plurality of legs 103 is a lever 131 mounted on a pivot 132. The lever 131 of each leg selected from the plurality of legs 103 rotates around the associated pivot 132 to give the appearance of motion. The lever 131 comprises a decorative tip 161 and an LED 162. The lever 131 further comprises a pawl end 164 and a decorative end 165. The decorative end 165 is the end of the lever 131 that is distal from the pawl end 164.

Each of the plurality of legs 103 has an appearance that coordinates with and supplements the sentiment of the image 121 presented on the decorative plate 102. In the first potential embodiment of the disclosure, each of the plurality of legs 103 has the appearance of being the legs of the Humm-Bug.

Each of the plurality of legs 103 comprises a lever 131, a pivot 132, a return spring 133, and a cable 163.

The lever 131 is a hollow shaft structure. The lever 131 is a structure that projects beyond the perimeter of the mechanism cover 122 to give the appearance of a leg associated with the image 121 of the Humm-Bug. The lever 131 is moved by the drive mechanism 104 during normal use of the invention 100.

The pivot 132 mounts the lever 131 onto the decorative plate 102. The pivot 132 is a shaft that projects perpendicularly from the second anterior surface 192 of the decorative plate 102. The lever 131 rotates around the pivot 132.

The return spring 133 is a tension spring. The return spring 133 is a helical coil spring. The return spring 133 attaches to the lever 131 at a point between the pivot 132 and the pawl end 164 of the lever 131. The return spring 133 attaches to the second anterior surface 192 of the decorative plate 102. The return spring 133 returns the lever 131 to its original position after the lever 131 has been deflected by the drive mechanism 104.

The decorative tip 161 is a decorative structure that attaches to the decorative end 165 of the lever 131. The decorative tip 161 coordinates with and supplements the image 121 displayed on the decorative plate 102. In the first potential embodiment of the disclosure, decorative tip 161 has the appearance of being the foot of the Humm-Bug.

The LED 162 is a commercially available electrically powered light source. The LED 162 mounts visibly on the decorative tip 161. The cable 163 attaches the LED 162 to the control system 105. The cable 163 inserts through the hollow interior of the lever 131. The LED 162 and the cable 163 are discussed in greater detail elsewhere in this disclosure.

The pawl end 164 meshes with the toothed gear 142 such that the rotation of the toothed gear 142 displaces the pawl end 164 of the lever 131 in the manner of a ratchet. Specifically, the return spring 133 is deformed when the pawl end 164 of the lever 131 is deflected by the toothed gear 142. The elastic nature of the return spring 133 creates a displacing force that opposes the deformation of the pawl end 164 of the lever 131 created by toothed gear 142. The displacing force is in the direction that returns the return spring 133 to its relaxed shape. The displacement of the pawl end 164 of the lever 131 created by the toothed gear 142 and the return spring 133 generates a visible motion in the decorative end 165 of the lever 131.

The control system 105 is an electrical system. The control system 105 provides the electrical power required by the drive mechanism 104. The control system 105 illuminates the LED 162 mounted on each of the plurality of legs 103. The control system 105 generates an audible sound. The audible sound is selected to coordinate with the sentiment of the image 121. The control system 105 comprises an audio source 151, a speaker 152, a battery 153, a limit resistor 154, a master switch 155, and a mute switch 156. The audio source 151 further comprises an audio file 157.

The audio source 151 is a commercially available electrical device often referred to as a recorder. The audio source 151 converts an audio file 157 into an electrical signal that is transmitted to the speaker 152. The speaker 152 is a commercially available transducer. The speaker 152 converts the electrical signals generated by the audio source 151 into an audible sound. The audio file 157 is a digital representation of the sound that is generated by the audio source 151 and the speaker 152. Any first audio file 157 can be replaced with a second audio file 157 to customize the invention 100 to the holiday or the taste of the user.

The battery 153 is a commercially available source of electrical energy. The battery is discussed in greater detail elsewhere in this disclosure.

The limit resistor 154 is an electrical device that limits the flow of current through each LED 162 associated with the plurality of legs 103. The master switch 155 is a commercially available maintained switch. The master switch 155 controls the flow of electrical current from the battery 153 that powers the drive motor 141, the audio source 151 and each LED 162 contained within the plurality of legs 103.

The master switch 155 is essentially the on-off switch of the invention 100. The mute switch 156 is a commercially available maintained switch. The mute switch 156 is placed in series between the master switch 155 and the audio source 151. The mute switch 156 is used to interrupt the flow of electric current into the audio source 151. The mute switch 156 allows the invention 100 in silence.

The following definitions were used in this disclosure:

Anterior: As used in this disclosure, anterior is a term that is used to refer to the front side or direction of a structure. When comparing two objects, the anterior object is the object that is closer to the front of the structure.

Audio File: As used in this disclosure, an audio file is a digital representation of a sound that is used to store a recording of the sound. Separate hardware is used to convert the digital representation of the sound into an audible sound.

Audio Source: As used in this disclosure, an audio source is a device that generates electrical signals that can be converted into audible sounds by a speaker.

Battery: As used in this disclosure, a battery is a chemical device consisting of one or more cells, in which chemical energy is converted into electricity and used as a source of power.

Cable: As used in this disclosure, a cable is a collection of insulated wires covered by a protective casing. The cable is used for transmitting electricity or telecommunication signals.

Control System: As used in this disclosure, a control system is a first device or system that manages and regulates the behavior or operation of a second device or system.

Decorative: As used in this disclosure, decorative is an adjective that refers to a first object or item that is used with a second object or item of the purpose of making the second object or item more attractive. Decorative will generally, but not necessarily, implies making the second object or item more attractive visually.

Diode: As used in this disclosure, a diode is a two terminal semiconductor device that allows current flow in only one direction. The two terminals are called the anode and the cathode. Electric current is allowed to pass from the anode to the cathode.

Elastic: As used in this disclosure, an elastic is a material or object that deforms when a force is applied to it and that is able to return to its relaxed shape after the force is removed. A material that exhibits these qualities is also referred to as an elastomeric material.

Electric Motor: In this disclosure, an electric motor is a machine that converts electric energy into rotational mechanical energy.

Gear: As used in this disclosure, a gear is a toothed wheel, cylinder, or other toothed mechanical element, that is used to transmit motion, a change of speed, or a change of direction to a second toothed wheel, cylinder, or other toothed mechanical element.

Helix: As used in this disclosure, a helix is the three-dimensional structure that would be formed by a wire that is wound uniformly around the surface of a cylinder or a cone. If the wire is wrapped around a cylinder the helix is called a cylindrical helix. If the wire is wrapped around a cone, the helix is called a conical helix. A synonym for conical helix would be a volute.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Image: As used in this disclosure, an image is an optical representation or reproduction of an indicia of the appearance of something or someone.

Indicia: As used in this disclosure, the term indicia refers to a set of markings that identify a sentiment.

LED: As used in this disclosure, an LED is an acronym for a light emitting diode. A light emitting diode is a diode that is also a light source.

Limit Resistor: As used in this disclosure, a limit resistor is an electrical resistor that is used to limit the flow of electric current through an electrical circuit.

Maintained Switch: A used in this disclosure, a maintained switch is a switch that maintains the position that was set in the most recent switch actuation. A maintained switch works in an opposite manner to a momentary switch.

Motor: As used in this disclosure, a motor refers to the method of transferring energy from an external power source into mechanical energy.

Pawl: As used in this disclosure, a pawl is a rotating bar or lever with a free end that engages a toothed structure.

Pivot: As used in this disclosure, a pivot is a rod or shaft around which an object rotates or swings.

Plate: As used in this disclosure, a plate is a smooth, flat and semi-rigid or rigid structure that has at least one dimension that: 1) is of uniform thickness; and 2) that appears thin relative to the other dimensions of the object. Plates often have a rectangular or disk-like appearance. As defined in this disclosure, plates may be made of any material, but are commonly made of metal. When made of wood, a plate is often referred to as a board.

Posterior: As used in this disclosure, posterior is a term that is used to refer to the side of an object that is distal or in the opposite direction of the anterior side. When comparing two items, the posterior item is the item that is distal from the front of the object.

Ratchet: As used in this disclosure, a ratchet is a device comprising a pawl or hinged catch that engages the sloping teeth of a wheel or bar permitting motion in one direction only.

Relaxed Shape: As used in this disclosure, a structure is considered to be in its relaxed state when no shear, strain, or torsional forces are being applied to the structure.

Resistor: As used in this disclosure, a resistor is a well-known and commonly available electrical device that inhibits the flow of electricity through an electric circuit. Within an electric circuit processing alternating currents, the resistor will not affect the phase of the alternating current. A current flowing through a resistor will create a voltage across the terminals of the resistor.

Sentiment: As used in this disclosure, a sentiment refers to a symbolic meaning or message that is communicated through the use of an image, potentially including a text-based image.

Shell: As used in this disclosure, a shell is a structure that forms an outer covering intended to contain an object. Shells are often, but not necessarily, rigid or semi-rigid structures that are intended to protect the object contained within it.

Speaker: As used in this disclosure, a speaker is an electrical transducer that converts an electrical signal into an audible sound.

Spring: As used in this disclosure, a spring is a device that is used to store mechanical energy. This mechanical energy will often be stored by: 1) deforming an elastomeric material that is used to make the device; 2) the application of a torque to a rigid structure; or 3) a combination of the previous two items.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Tension Spring: As used in this disclosure, a tension spring, also commonly referred to as an extension spring, is a wire coil that resists forces attempting to pull the wire coil in the direction of the center axis of the wire coil. The tension spring will return to its original position when the pulling force is removed.

Transducer: As used in this disclosure, a transducer is a device that converts a physical quantity, such as pressure or brightness into an electrical signal or a device that converts an electrical signal into a physical quantity.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A festive frame comprising:

wherein the festive frame comprises a backing plate, a decorative plate, a plurality of legs, a drive mechanism, and a control system;

wherein the decorative plate attaches to the backing plate;

wherein the plurality of legs, the drive mechanism, and the control system attach to the decorative plate;

wherein the festive frame is a display device;

wherein the festive frame displays a sentiment;

wherein the festive frame has a mechanical component and an electrical component;

wherein the mechanical component of the festive frame physically moves the sentiment;

wherein the electrical component of the sentiment activates a plurality of light sources to illuminate, activates a speaker to generate audible sounds, and powers the mechanical component of the festive frame;

wherein the mechanical component comprises the plurality of legs and the drive mechanism;

wherein the electrical component comprises the control system;

wherein the backing plate is a rectangular plate;

wherein the backing plate further comprises a plurality of mounting holes, a battery chamber, and a battery chamber cover;

wherein the plurality of mounting holes, the battery chamber, and the battery chamber cover are formed in the rectangular plate that forms the backing plate;

wherein the backing plate is further defined with a first anterior surface and a first posterior surface;

wherein the decorative plate is a plate;

wherein the decorative plate further comprises the image and a mechanism cover;

wherein the decorative plate is further defined with a second anterior surface and a second posterior surface;

wherein the mechanism cover is a shell mounted on the second anterior surface of the decorative plate;

wherein the image is applied to the second anterior surface of the decorative plate;

wherein the mechanism cover encloses the drive mechanism and the control system;

wherein the drive mechanism is an electrically powered mechanical device;

wherein the drive mechanism generates the force required to move each of the plurality of legs;

wherein the control system is an electrical system;

wherein the control system provides the electrical power required by the drive mechanism;

wherein the control system generates an audible sound;

wherein the audible sound is selected to coordinate with the sentiment of the image;

wherein each of the plurality of mounting holes is a keyhole formed in the first posterior surface of the backing plate;

wherein the battery chamber is a cavity formed in the first posterior surface of the backing plate;

wherein the battery chamber is sized to receive the battery;

wherein the battery chamber cover is a lid that encloses the battery chamber;

wherein the second posterior surface of the decorative plate attaches to the first anterior surface of the backing plate;

wherein the exterior surface of the mechanism cover is decorated;

wherein the drive mechanism comprises a drive motor and a toothed gear;

wherein the toothed gear attaches to the drive motor such that the drive motor will rotate the toothed gear;

wherein the drive motor is an electrical motor;

wherein the drive motor attaches to the second anterior surface of the decorative plate;

wherein the plurality of legs, the drive mechanism, and the control system attach to the second anterior surface of the decorative plate;

wherein any leg selected from the plurality of legs is identical to the legs remaining in the plurality of legs;

wherein each of the plurality of legs comprises a lever, a pivot, a return spring, and a cable;

wherein the lever is a hollow shaft structure;

wherein the pivot and the return spring attach to the lever;

wherein the cable inserts into the lever;

wherein each lever mounts on the associated pivot;

wherein the lever of each leg selected from the plurality of legs rotates around the associated pivot;

wherein the lever comprises a decorative tip and an LED;

wherein the lever further comprises a pawl end and a decorative end;

wherein the decorative end is the end of the lever that is distal from the pawl end;

wherein the decorative tip attaches to the decorative end of the lever;

wherein the LED attaches to the decorative tip.

2. The festive frame according to claim 1 wherein the drive mechanism deflects each lever;

wherein each pivot mounts the associated lever onto the decorative plate;

wherein each pivot is a shaft that projects perpendicularly from the second anterior surface of the decorative plate;

wherein the lever rotates around the pivot.

3. The festive frame according to claim 2 wherein the return spring is a tension spring;

wherein the return spring is a helical coil spring;

wherein the return spring attaches to the lever at a point between the pivot and the pawl end of the lever;

wherein the return spring attaches to the second anterior surface of the decorative plate;

wherein the return spring returns the lever to its original position after the drive mechanism has deflected the lever.

4. The festive frame according to claim 3 wherein the decorative tip is a decorative structure that attaches to the decorative end of the lever;

wherein the decorative tip coordinates with and supplements the image displayed on the decorative plate;

wherein the LED mounts visibly on the decorative tip;

wherein the cable attaches the LED to the control system.

5. The festive frame according to claim 4 wherein the pawl end meshes with the toothed gear such that the rotation of the toothed gear deflects the pawl end of the lever;

wherein the return spring is deformed when the toothed gear deflects the pawl end of the lever;

wherein the elastic nature of the return spring creates a displacing force that opposes the deformation of the pawl wherein the displacement of the pawl end of the lever created by the toothed gear and the return spring generates a visible motion in the decorative tip of the lever.

6. The festive frame according to claim 5 wherein the control system comprises an audio source, a speaker, a battery, a limit resistor, a master switch, and a mute switch;

wherein the audio source further comprises an audio file;

wherein the audio source, the speaker, the battery, the limit resistor, the master switch, and the mute switch are electrically interconnected;

wherein the audio file is contained in the audio source.

7. The festive frame according to claim 6 wherein the audio source is an electrical device often referred to as a recorder;

wherein the audio source converts the audio file into an electrical signal that is transmitted to the speaker;

wherein the speaker is a transducer;

wherein the speaker converts the electrical signals generated by the audio source into an audible sound;

wherein any first audio file is interchangeable with a second audio file on the audio source.

8. The festive frame according to claim 7 wherein the limit resistor is an electrical device;

wherein the limit resistor limits the flow of current through each LED associated with the plurality of legs;

wherein the master switch is a maintained switch;

wherein the mute switch is a maintained switch;

wherein the master switch controls the flow of electrical current from the battery that powers the drive motor, the audio source and each LED contained within the plurality of legs.

* * * * *